US009172478B2

(12) United States Patent
Kim

(10) Patent No.: US 9,172,478 B2
(45) Date of Patent: Oct. 27, 2015

(54) FREQUENCY SWITCHING METHOD AND APPARATUS FOR RADIO DATA SYSTEM

(75) Inventor: Jin Young Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 168 days.

(21) Appl. No.: 13/412,053

(22) Filed: Mar. 5, 2012

(65) Prior Publication Data

US 2012/0252388 A1 Oct. 4, 2012

(30) Foreign Application Priority Data

Mar. 28, 2011 (KR) ..... 10-2011-0027461

(51) Int. Cl.
*H04H 20/22* (2008.01)

(52) U.S. Cl.
CPC ..... *H04H 20/22* (2013.01); *H04H 2201/13* (2013.01)

(58) Field of Classification Search
USPC ..... 455/45, 134, 137, 103, 192.2, 273, 455/277.1
See application file for complete search history.

(56) References Cited

U.S. PATENT DOCUMENTS

| | | | | |
|---|---|---|---|---|
| 5,428,825 | A * | 6/1995 | Tomohiro et al. | 455/186.1 |
| 6,141,536 | A * | 10/2000 | Cvetkovic et al. | 455/45 |
| 6,711,390 | B1 | 3/2004 | Moers | |
| 2007/0129035 | A1 * | 6/2007 | Olson et al. | 455/179.1 |
| 2010/0233980 | A1 * | 9/2010 | Uppala | 455/185.1 |
| 2011/0306313 | A1 * | 12/2011 | Jaisimha et al. | 455/185.1 |

FOREIGN PATENT DOCUMENTS

EP 0 326 746 A2 8/1989

* cited by examiner

*Primary Examiner* — Junpeng Chen
(74) *Attorney, Agent, or Firm* — Jefferson IP Law, LLP

(57) ABSTRACT

A method and an apparatus for switching from the main frequency to an Alternative Frequency (AF) providing the same station is provided. The method includes measuring a received signal strength of a main frequency, receiving at least one alternative frequency list, establishing an accumulated alternative frequency list including all previously received alternative frequency lists, comparing the received signal strength of the main frequency with a predefined reference received signal strength, and attempting, when the received signal strength of the main frequency is less than the reference received signal strength, switching to an alternative frequency in the accumulated alternative frequency list.

19 Claims, 9 Drawing Sheets

FREQUENCY SWITCHING METHOD AND APPARATUS FOR RADIO DATA SYSTEM

PRIORITY

This application claims the benefit under 35 U.S.C. §119 (a) of a Korean patent application filed on Mar. 28, 2011 in the Korean Intellectual Property Office and assigned Serial No. 10-2011-0027461, the entire disclosure of which is hereby incorporated by reference.

BACKGROUND OF THE INVENTION

1. Field of the Invention

The present invention relates to a frequency switching method for a Radio Data System (RDS). More particularly, the present invention relates to a method and an apparatus for switching from the main frequency to an Alternative Frequency providing the same station.

2. Description of the Related Art

An RDS is a system for providing information services (such as a traffic information service, a paging service, and an automatic tuning) using a subcarrier of a Frequency Modulation (FM) broadcast. A terminal, such as mobile terminal and a navigation device can be configured to provide a user with the aforementioned information service using RDS data.

The RDS data may include an Alternative Frequency (AF) list, a broadcast station name, a nationality of station, and a Program Identification (PI) code identifies the station.

Typically, an RDS-enabled terminal provides an automatic tuning function to switch from the main frequency to one of alternative frequencies listed in the AF list. This means that the user does not need to retune the frequency, but the terminal measures the received signal strength of the main frequency and switches, when the received signal strength is equal to or less than a threshold value, to an alternative frequency, resulting in improvement of user convenience.

However, when the terminal measures the received signal strength of the alternative frequency and determines the PI code, a sound discontinuation effect occurs. The sound discontinuation is an effect in which no sound is heard for a few milliseconds or seconds in the middle of listening to the radio.

Typically, the alternative frequency-switching function is configured to be executed in an environment where the electric field does not vary abruptly. In such an environment, there is no need to determine the received signal strength of the main frequency so frequently that the received signal strength measurement cycle can be set to a relatively long time.

In a case where the long measurement cycle is applied in the environment wherein the electric field varies abruptly, the terminal cannot switch to an alternative frequency strong enough in the received signal strength in due time.

FIG. 1 illustrates a broadcasting system in which stations are overlapped in their radio coverage regions according to the related art.

Referring to FIG. 1, three frequencies, i.e., 102.4 Mhz, 105.1 Mhz, and 88.3 Mhz, are overlapped in a region 11. In the region 11, the electric field varies abruptly such that the received signal strength of the main frequency is likely to decrease. At this time, the alternative frequency is likely to have a good signal strength and thus it is a good policy to switch to the alternative frequency quickly. For this purpose, the received signal strength determination cycle needs to be set to a short time.

However, if the received signal strength determination cycle is too short, the frequency switching occurs frequently, resulting in an increase of the number of sound discontinuations.

Especially in a building or basement, both the current and alternative frequencies become weak in strength. In this case, the frequency switching to the alternative frequency is likely to fail due to the weak signal strengths of both the current and alternative frequencies. If the terminal attempts frequency switching without consideration of such environment, the sound discontinuation effect occurs frequently without successful frequency switching.

The weak electric field environment may occur temporarily when the terminal passes through a tunnel or has change in antenna conditions. In such a case, since the electric field condition is recovered soon, maintaining the main frequency is preferred. However, the terminal of the related art attempts frequency switching repeatedly because the received signal strength of the current signal is poor without consideration that the poor signal condition can be recovered soon, resulting in frequency sound discontinuation effects.

There is therefore a need for an apparatus and a method for switching between frequencies in the RDS that is capable of reducing the occurrence of sound discontinuation effect in consideration of various radio listening environments.

SUMMARY OF THE INVENTION

Aspects of the present invention are to address at least the above-mentioned problems and/or disadvantages and to provide at least the advantages described below. Accordingly, an aspect of the present invention is to provide a frequency switching method and an apparatus for a Radio Data System (RDS) that is capable of minimizing the occurrence of a sound discontinuation effect.

In accordance with an aspect of the present invention, a frequency switching method for an RDS is provided. The method includes measuring a received signal strength of a main frequency, receiving at least one alternative frequency list, establishing an accumulated alternative frequency list including all previously received alternative frequency lists, comparing the received signal strength of the main frequency with a predetermined reference received signal strength, and attempting, when the received signal strength of the main frequency is less than the reference received signal strength, switching to an alternative frequency in the accumulated alternative frequency list.

In accordance with an aspect of the present invention, an RDS apparatus is provided. The RDS apparatus includes an RDS tuner for receiving a radio signal containing an alternative frequency list, an RDS data processing unit for extracting the alternative frequency list from the radio signal, an accumulated alternative frequency list database for storing an accumulated alternative frequency list including all previously received alternative frequency lists, and a frequency switching module for establishing the accumulated alternative frequency list, for measuring a received signal strength of main frequency at a predetermined cycle, for comparing the received signal strength of the main frequency with a predetermined reference received signal strength, and for attempting, when the received signal strength of the main frequency is less than the reference received signal strength, switching to an alternative frequency in the accumulated alternative frequency list.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1:
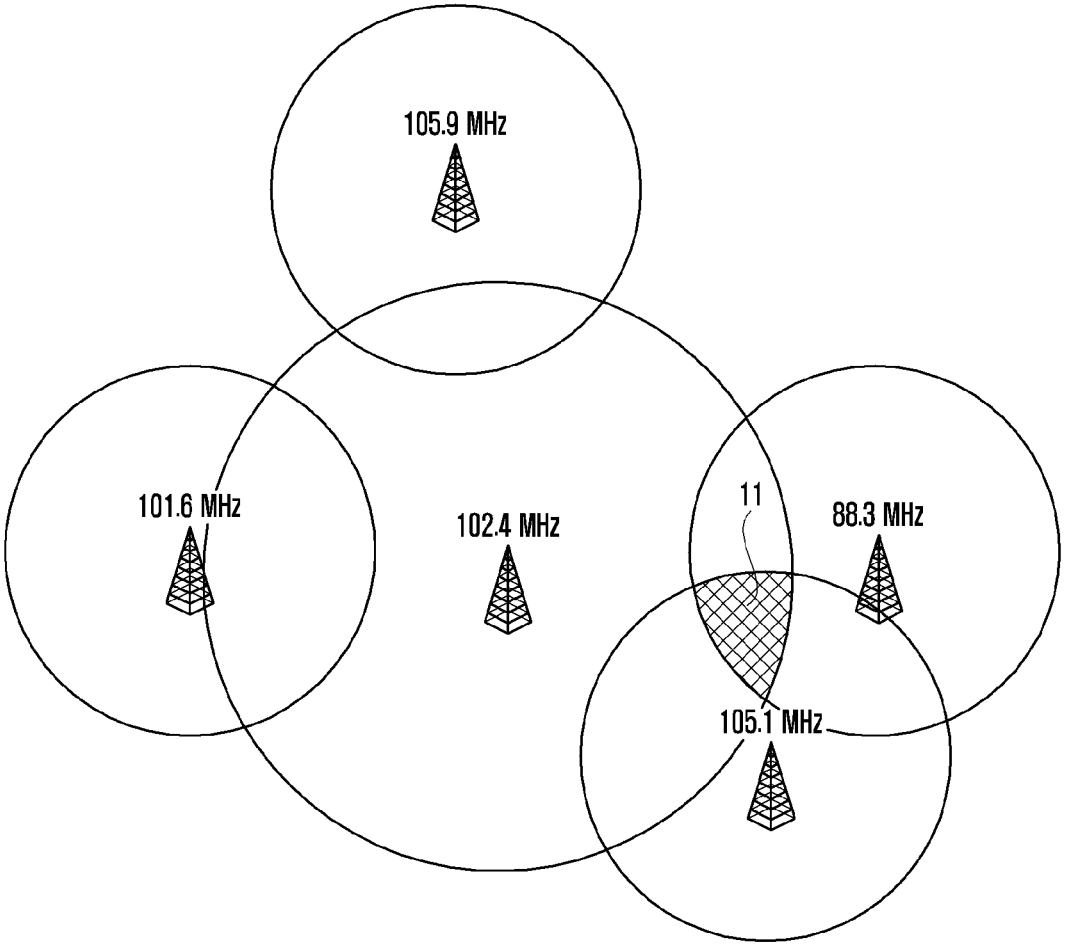
FIG. 1 (RELATED ART)
FIG. 1 illustrates a broadcasting system in which stations are overlapped in their radio coverage regions according to the related art.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

In exemplary embodiments of the present invention, the terms 'Received Signal Strength Indication (RSSI)' and 'received signal strength' denote the strength of the signal received by a Radio Data System (RDS) terminal.

In exemplary embodiments of the present invention, the terms 'reference RSSI' and 'reference received signal strength' denote the received signal strength to be referenced to determine whether to maintain the main frequency or to switch to an alternative frequency. For example, if the reference RSSI is 10 and if the RSSI of the main frequency is 9, the terminal attempts switching to an alternative frequency.

In exemplary embodiments of the present invention, the terms 'valid RSSI' and 'valid received signal strength' denote the received signal strength to be referenced to determine whether the corresponding frequency is listenable. For example, if the valid RSSI is 10 and if the RSSIs of the frequencies of 102.3 MHz and 98.2 MHz in the AF list are 9 and 11 respectively, the terminal determines that the RSSI of the frequency of 98.2 MHz is a listenable frequency. In such case, the terminal performs frequency switching to the alternative frequency of which RSSI is greater than the valid RSSI.

In exemplary embodiments of the present invention, the terms 'Alternative Frequency (AF) list' and 'real time alternative frequency list' denote a list of the alternative frequencies that the terminal receives periodically while listening to the radio. The real time AF list is stored in a real time AF list database, and when the real time AF list is received, the terminal replaces the old real time AF list with the newly received real time AF list.

In exemplary embodiments of the present invention, the terms 'accumulated AF list' and 'accumulated alternative frequency list' denote the list of the alternative frequency list having the received alternative frequencies. The accumulated AF list is stored in an accumulated AF list database, and whenever the AF list is received, the terminal accumulates the AF list in the accumulated AF list database. At this time, the terminal compares the accumulated AF list and the received AF list and, if the AF list does not exist, adds the AF list. It is possible to set a maximum number of AFs that can be included in the accumulated AF list and, in this case, the terminal can configure the accumulated AF list with the maximum number of AFs.

In exemplary embodiments of the present invention, the terms 'AF RSSI list' and 'alternative frequency received signal strength list' denote the list of the received signal strengths of AFs that are measured by the terminal, and the terminal updates the AF RSSI list by adding only the RSSIs less than the valid RSSI.

In exemplary embodiments of the present invention, the terms 'good RSSI' and 'good received signal strength' denote a reference value for determining whether the current electric field condition is good. The good RSSI is set to a value less than the reference RSSI and valid RSSI. The terminal determines whether the proportion of the AFs of which RSSIs are equal to or greater than the good RSSI is equal to or greater than a predefined value and, if so, determines that the current electric field is good and thus maintains the accumulated AF list. Otherwise, if the proportion of the AFs of which RSSIs are equal to or greater than the good RSSI is equal to or greater than the predefined value, the terminal determines that the current electric field is not good and thus deletes the accumulated AF list.

In an exemplary embodiment of the present invention, the terminal can be any of a cellular terminal, a Portable Multimedia Player (PMP), a Personal Digital Assistant (PDA), a Motion Pictures Expert Group (MPEG-1 or MPEG-2) Audio Layer-3 (MP3) player, a navigation terminal, and their equivalents, that are equipped with an RDS tuner.

FIGS. 1 through 6B, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly stated otherwise. A set is defined as a non-empty set including at least one element.

Figure 2:
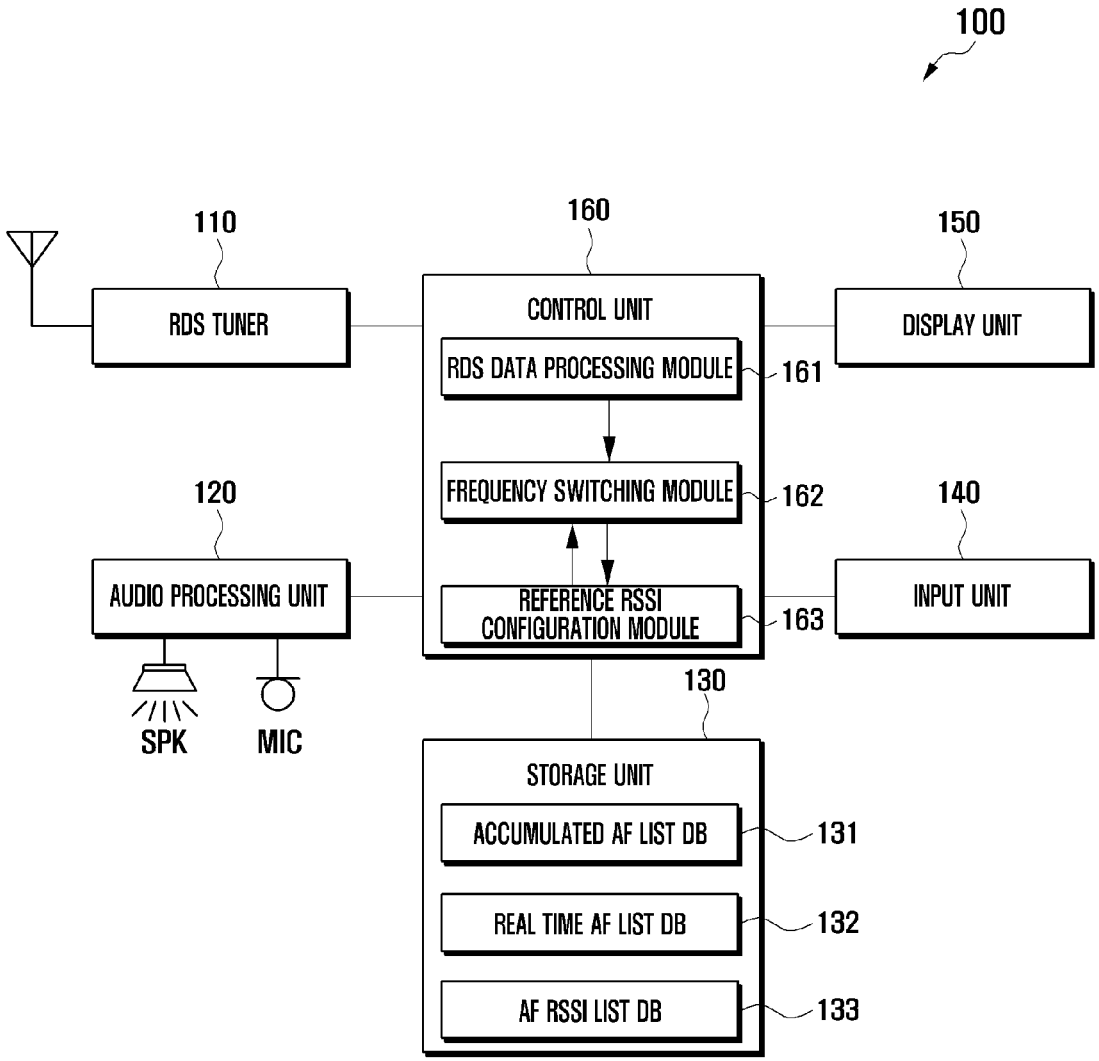
FIG. 2 is a block diagram illustrating a configuration of a terminal supporting a Radio Data System (RDS) according to an exemplary embodiment of the present invention.

FIG. 2 is a block diagram illustrating a configuration of a terminal supporting an RDS according to an exemplary embodiment of the present invention.

Referring to FIG. 2, a terminal 100 may include an RDS tuner 110, an audio processing unit 120, a storage unit 130, an input unit 140, a display unit 150, and a control unit 160. The control unit 160 controls overall operations of the internal components of the terminal 100 and may include an RDS data processing module 161, a frequency switching module 162, and a reference RSSI configuration module 163. The storage unit 130 may include an accumulated AF list database 131, a real time AF list database 132, and an AF RSSI list database 133.

The RDS tuner 110 receives the radio data broadcast signal by means of an antenna under the control of the control unit 160 according to a broadcast channel selection or switching signal input through the input unit 140 by the user and outputs the radio data broadcast signal to the audio processing unit 120 and the RDS data processing module 161.

The audio processing unit 120 processes audio signals and includes a speaker (SPK) as an output part and a microphone (MIC) as an input part. The audio processing unit 120 includes a demodulation unit (not shown) and an amplification unit (not shown). The demodulation unit performs demodulation on the radio data broadcast signal input from the RDS tuner 110 and outputs an audio signal to the amplification unit. The amplification unit adjusts the volume of the audio signal input from the demodulation unit and outputs the audio signal through the SPK under the control of the control unit 160.

The storage unit 130 is responsible for storing programs and data needed for operations of the terminal 100 and is divided into a program region and a data region. The program region stores Operating System (OS) for controlling overall operations of the terminal 100 and application programs. The data region stores the data generated while the terminal 100 operates, such as audio and video data.

The accumulated AF list database 131 stores the accumulated AF list including all previously received AF lists. For example, if the terminal 100 receives the AF list including the frequencies of 92.2 MHz and 105.9 MHz and the AF list including 88.3 MHz and 102.4 MHz at the next cycle, the accumulated AF list database 131 stores the accumulated AF list including the frequencies of 92.2 MHz, 105.9 MHz, 88.3 MHz, and 102.4 MHz. The accumulated AF list database 131 can be configured with the maximum number of AF. When the terminal 100 attempts frequency switching, the accumulated AF list is used to select an AF.

The real time AF list database 132 stores the most recently received AF list received by the terminal 100. For example, if the terminal receives the AF list including the frequencies of 92.2 MHz and 105.9 MHz, the real time AF list database 132 stores the frequencies of 92.2 MHz and 105.9 MHz and, if the AF list including the frequencies of 88.3 MHz and 102.4 MHz is received at the next cycle, the real time AF list database 132 is updated such that the frequencies of 92.2 MHz and 105.9 MHz are replaced by the frequencies of 88.3 MHz and 102.4 MHz. The terminal 100 uses the real time AF list as the reference to determine whether to perform frequency switching. According to an exemplary embodiment of the present invention, the real time AF list database 132, as the component of the terminal 100, can be omitted.

The AF RSSI list database 133 stores the AF RSSI list including the RSSIs less than the valid RSSI that is previously set among the RSSIs of the AFs measured by the terminal 100. If it is determined that the AF's RSSI measured by the terminal 100 is less than the valid RSSI, the terminal updates the AF RSSI list with the measured RSSI. According to an exemplary embodiment of the present invention, the AF RSSI list database 133 as a component of the terminal 100 can be omitted.

The input unit 140 receives the key manipulation signal input by the user for controlling the terminal 100 and delivers the signal to the control unit 160. The input unit 140 can be implemented with a keypad including buttons or a touch panel. The input unit 140 generates the input signal for executing applications executable in the terminal 100 to the control unit 160 in response to the user input.

The display unit 150 can be implemented with one of a Liquid Crystal Display (LCD), Organic Light Emitting Diodes (OLEDs), and an Active Matrix OLED (AMOLED), and is a component for providing the user with graphic data. The display unit 150 displays radio application execution screen showing the information on the frequency to which the terminal 100 is tuned.

The RDS data processing module 161 extracts the RDS data containing the AF list from the radio data broadcast signal received by the RDS tuner 110 and outputs the RDS data to the frequency switching module 162.

The frequency switching module 162 performs switching to an AF by referencing the AF list received from the RDS data processing module 161. The frequency switching module 162 updates the accumulated AF list database 131 with the AF list received from the RDS data processing module 161. At this time, the frequency switching module 162 updates the accumulated AF list database 131 by adding the newly received AF list to all previously received AF lists.

The frequency switching module 162 measures the RSSI of the main frequency and, if the RSSI of the main frequency is less than the reference RSSI, attempts switching to the AF and measures the RSSIs of individual AFs of the accumulated AF list stored in the accumulated AF list database 131 in sequence. The frequency switching module 162 measures the RSSI of an AF and, if the measured RSSI is greater than a predefined valid RSSI, determines whether the Program Identification (PI) code of the AF is identical with the PI code of the main frequency and, if the PI codes are identical with each other, performs switching to the AF.

The frequency switching module 162 measures the RSSI of an AF and, if the measured RSSI is less than the valid RSSI, determines whether the RSSI measurement has been performed to all of the AFs in the accumulated AF list. If it is determined that the RSSI measurement has been performed to all of the AFs, the frequency switching module 162 deletes the accumulated AF list stored in the accumulated AF list database 131 and reconfigures the accumulated AF list using the received AF list.

If it is determined that the PI codes differ from each other, the code frequency switching module 162 can measure the RSSI of the next AF in the accumulated AF list. According to an exemplary embodiment of the present invention, if the PI codes differ from each other, the frequency switching module 162 repeats the PI code identification process up to a predefined number of times and, if there is no matched PI, measures RSSI of the next AF in the accumulated AF list.

According to an exemplary embodiment of the present invention, the frequency switching module 162 can update the real time AF list database 132 as well as the accumulated AF list database 131 with the received AF list. When updating the real time AF list database 132, the frequency switching module 162 replaces the real time AF list stored in the real time AF list database 132 with the newly received AF list.

If the RSSI of the main frequency is less than the reference RSSI, the frequency switching module 162 determines whether at least one AF exists in the real time AF list database 132 and, if so, attempts frequency switching to the AF. The frequency switching module 162 measures the RSSIs of the AFs in the accumulated AF list and stores the RSSIs of the AFs, which are less than the valid RSSI in the AF RSSI list database 133. If it is determined that the RSSIs of the entire AFs in the accumulated AF list are less than the valid RSSI, the frequency switching module 162 determines whether the proportion of the AFs of which RSSIs are equal to or greater than the good RSSI is equal to or greater than a predefined value. If so, the frequency switching module 162 maintains the accumulated AF list and, otherwise, deletes the accumulated AF list stored in the accumulated AF list database 131.

The reference RSSI configuration module 163 is a component for configuring the reference RSSI. Once the radio application is executed, the reference RSSI configuration module 163 sets the reference RSSI to the first value. The frequency switching module 162 measures the RSSIs of all AFs in the accumulated AF list and, if the RSSIs are less than the valid RSSI, transfers a reference RSSI change signal to the reference RSSI configuration module 163, and the reference RSSI configuration module 163 sets the reference RSSI to a second value which is less than the first value. After setting the reference RSSI to the second value, the reference RSSI configuration module 163 starts a timer, and after a predefined time (T) elapses, resets the reference RSSI to the first value.

Hereinafter, with the knowledge of the above-described configuration of the terminal 100, a description is made of the frequency switching procedure of the terminal 100.

Figure 3:
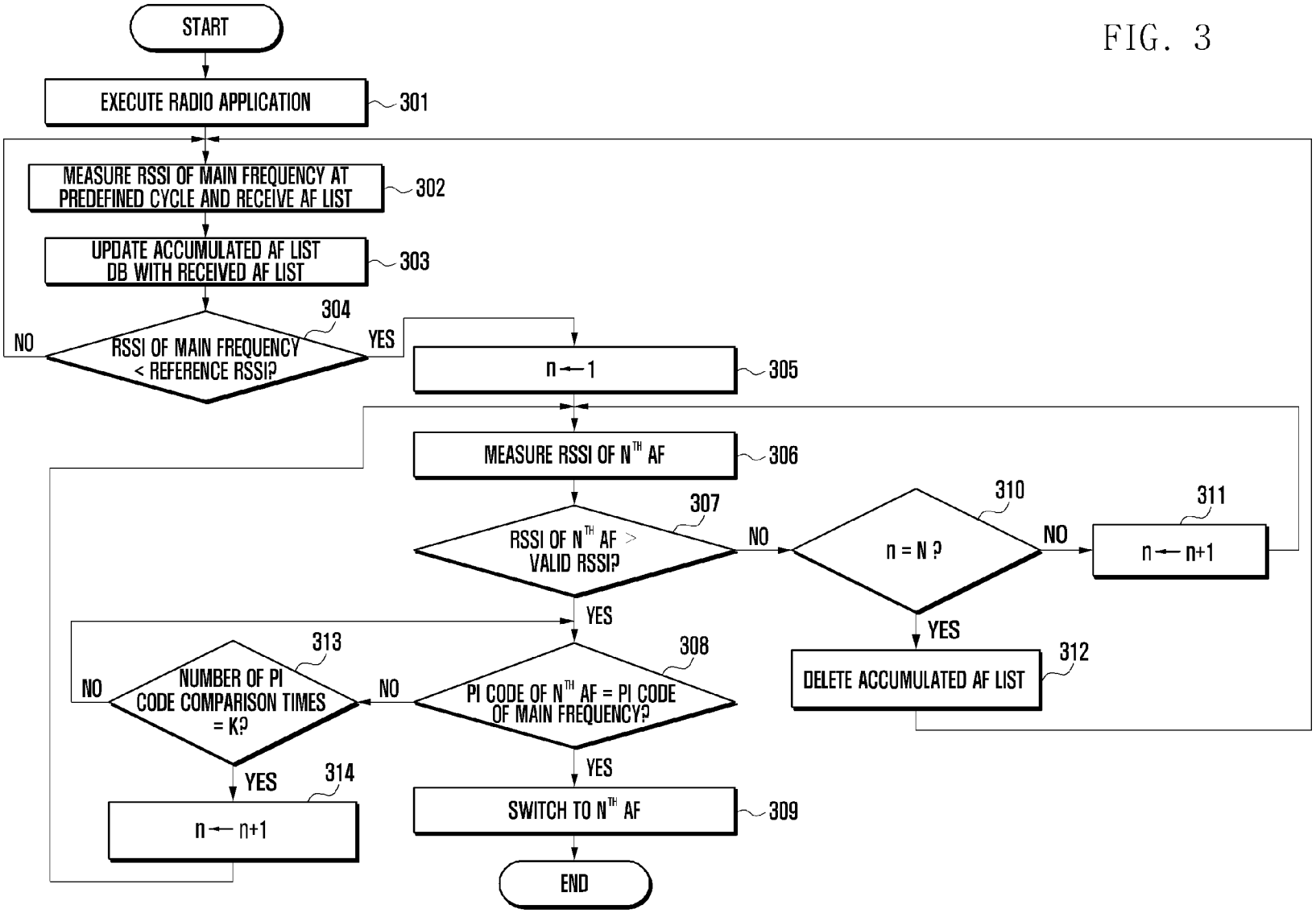
FIG. 3 is a flowchart illustrating a frequency switching method of a terminal according to an exemplary embodiment of the present invention.

FIG. 3 is a flowchart illustrating a frequency switching method of a terminal according to an exemplary embodiment of the present invention.

Referring to FIG. 3, the frequency switching method suitable for an environment where the received signal strength decreases when moving in the region multiple frequencies are overlapped is illustrated.

The control unit 160 executes the radio application at step 301. The control unit 160 detects the user command input by means of the input unit 140 and executes the radio application.

The frequency switching module 162 measures the RSSI of the main frequency by means of the RDS tuner 110 at a predefined cycle and receives the AF list at step 302. The RDS tuner 110 receives the radio data broadcast signal including the AF list from a broadcast station and delivers the radio data broadcast signal to the RDS data processing module 161 and frequency switching module 162. The RDS processing module 161 extracts the AF list from the radio data broadcast signal and transfers the radio data broadcast signal to the frequency switching module 162, and the frequency switching module 162 measures the RSSI of the radio data broadcast signal received by the RDS tuner 110. It is preferred that the RSSI measurement of the main frequency and the receipt of the AF list are performed at a cycle equal to or shorter than 5 seconds (e.g., 3 seconds). In the environment where the received signal strength decreases abruptly, the RSSI of the main frequency needs to be checked frequently.

The frequency switching module 162 updates the accumulated AF list database 131 with the received AF list at step 303. The accumulated AF list database 131 stores all previously received accumulated AF lists and is updated by accumulating the newly received AF list. The frequency switching module 162 compares the accumulated AF lists and the newly received AF list to update the accumulated AF list database 131 without overlapping of the AF lists. According to an exemplary embodiment of the present invention, a maximum number of AFs of the accumulated AF list can be set and, in this case, the frequency switching module 162 can configure the accumulated AF list with up to the maximum number of AFs. For example, if the maximum number of AF is set to 25, the frequency switching module 162 can establish the AF list with up to 25 AFs.

The frequency switching module 162 compares the RSSI of the main frequency and a predefined reference RSSI at step 304. According to an exemplary embodiment of the present invention, the reference RSSI denotes the received signal strength to be referenced for determining whether to maintain the main frequency or switch to an AF. If it is determined that the RSSI of the main frequency is less than the reference RSSI, the frequency switching module 162 attempts switching to the AF. For example, if the reference RSSI is 10 and the RSSI of the main frequency is 9, the frequency switching module 162 performs switching to the AF.

During the attempted switching to the RS, the frequency switching module 162 sets n (index of the AF in the AF list) to 1 at step 305. This means that the first AF of which RSSI is measured is selected from the accumulated AF. The frequency switching module 162 measures the RSSI of the $n^{th}$ AF at step 306. If n is set to 1, the frequency switching module 162 measures the RSSI of the first AF.

The frequency switching module 162 determines whether the RSSI of the $n^{th}$ AF is equal to or greater than the valid RSSI at step 307. According to an exemplary embodiment of the present invention, the valid RSSI denotes the RSSI to be referenced to determine whether the RSSI of each AF in the accumulated AF list is good enough to listen to the corresponding AF.

If it is determined that the RSSI of the $n^{th}$ AF is equal to or greater than the valid RSSI, the frequency switching module 162 determines whether the PI code of the $n^{th}$ AF matches with the PI code of the main frequency at step 308. If the PI code of the $n^{th}$ AF matches with the PI code of the main frequency, the frequency switching module 162 performs switching to $n^{th}$ AF at step 309.

If it is determined that the RSSI of the $n^{th}$ AF is less than the valid RSSI, the frequency switching module 162 determines whether n is equal to N at step 310. That is, the frequency switching module 162 determines whether the RSSI measurement has been performed to all of the AFs in the accumulated AF list at step 310. If it is determined that n is not equal to N, the frequency switching module 162 increments n by 1 at step 311. That is, the frequency switching module 162 selects the next AF for measuring the RSSI. The frequency switching module 162 returns to step 306 to measure the RSSI of the $n^{th}$ AF (AF having the next index).

If it is determined at step 310 that the RSSI measurement has been performed to all of the AFs in the accumulated AF list, the frequency switching module 162 deletes the accumulated AF list from the accumulated AF list database 131 at step 312. The frequency switching module receives the AF list at the predefined cycle at step 302 and establishes a new accumulated AF list at step 303.

If it is determined that the PI code of the $n^{th}$ AF does not match with the PI code of the main frequency at step 308, the frequency switching module 162 determines whether a number of PI code comparison times has reached a predefined value (K) at step 313. In the first exemplary embodiment of the present invention, the frequency switching module 162 performs the PI code comparison multiple times. Although the PI codes of the main frequency and AF match with each other, if the electric field is unstable, it is possible to determine the PI codes are not matching with each other. In order to avoid such a determination error, the frequency switching module 162 can perform the PI code comparison several times. The number of PI code comparison time is preferably set to 5.

If the PI code comparison times has reached K, the frequency switching module 162 increments n by 1 at step 314. That is, the frequency switching module 162 selects the next AF of which RSSI is to be measured. The frequency switching module 162 returns to step 306 to measure the RSSI of the $n^{th}$ AF (AF having the next index).

Since the main frequency's RSSI measurement cycle is set to 3 seconds in the first exemplary embodiment of the present invention, it is possible to attempt switching to the AF quickly in the environment where the received signal strength decreases abruptly. With the use of the accumulated AF list as well as the real time AF list, the number of selectable AFs increases, resulting in improvement of probability of switching to AF. In addition, by performing the PI code comparison process several times, it is possible to reduce the error occurrence probability as compared to the case when the PI code comparison is performed one time.

Figure 4A:
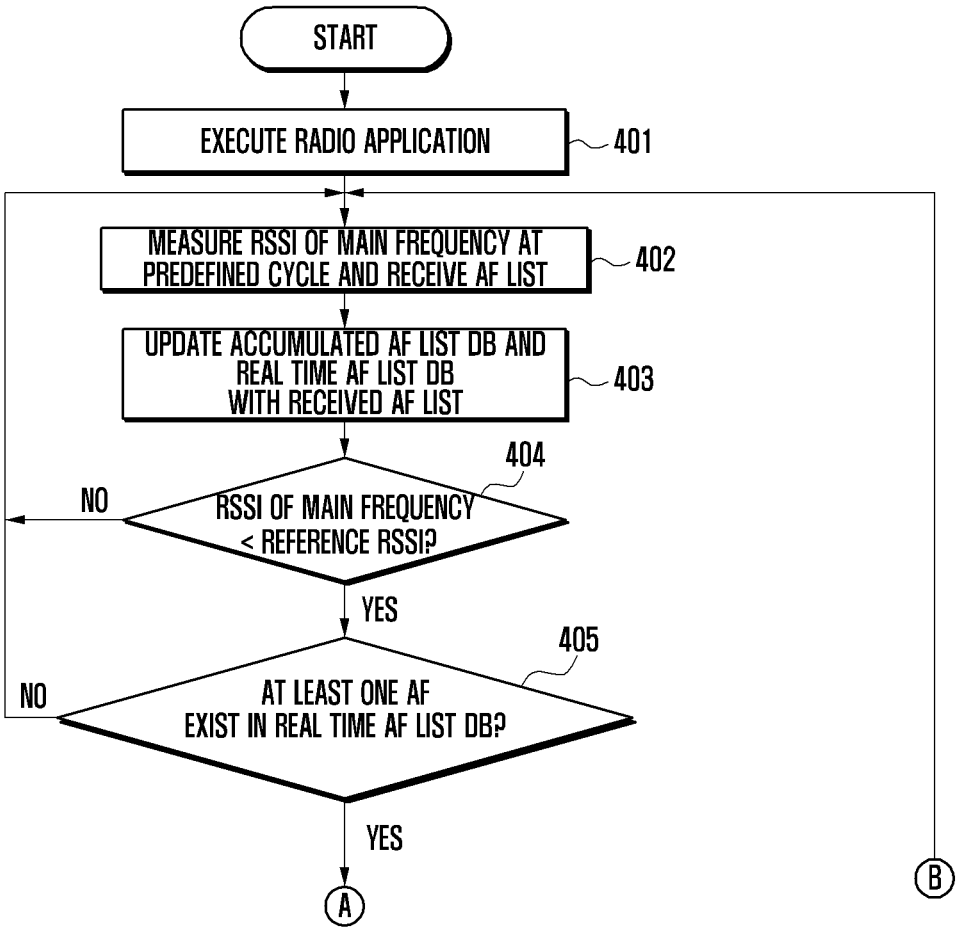
FIGS. 4A and 4B are flowcharts illustrating a frequency switching method of a terminal according to exemplary embodiments of the present invention.
Figure 4B:
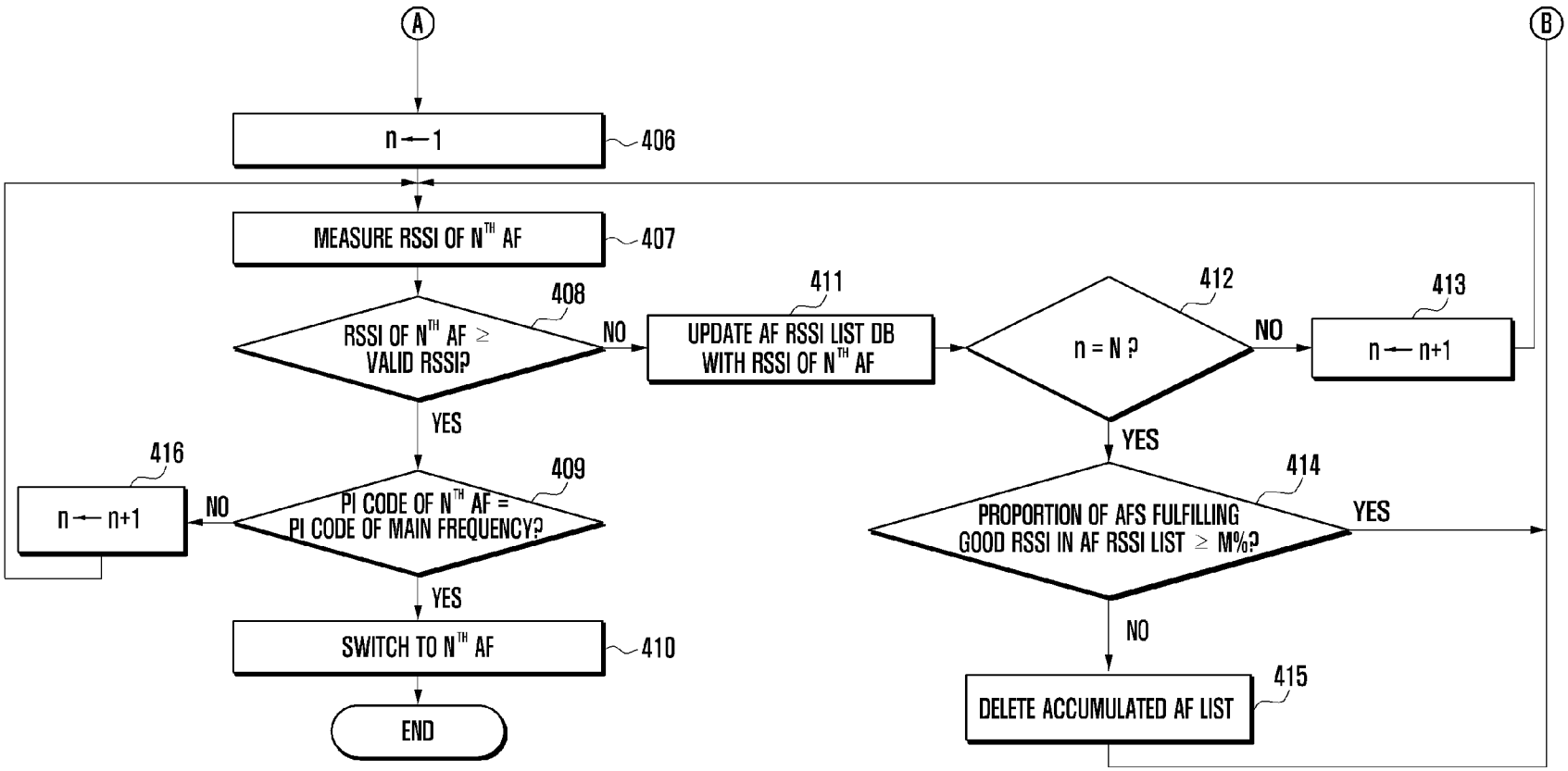

FIGS. 4A and 4B are flowcharts illustrating a frequency switching method of a terminal according to exemplary embodiments of the present invention.

Referring to FIGS. 4A and 4B, the frequency switching method suitable for an environment where a weak electric field is constantly maintained, such as a subway, indoors, and a basement of a building, is illustrated.

The control unit 160 executes the radio application at step 401, and the frequency switching module 162 measures RSSI of the main frequency received by means of the RDS tuner 110 at a predefined cycle and receives the AF list at step 402.

The frequency switching module 162 updates the accumulated database 131 and the real time AF list database 132 with the received AF list at step 403. The accumulated AF list database 132 stores the accumulated AF list including all previously received AF lists, and the real time AF list database stores only the newly received AF list. In order to update the real time AF list database 132, the frequency switching module 162 replaces the previously stored AF list with the newly received AF list.

The frequency switching module 162 compares the main frequency RSSI and a predefined reference RSSI and determines whether the RSSI of the main frequency is less than the reference RSSI at step 404.

If the RSSI of the main frequency is less than the reference RSSI, the frequency switching module 162 determines whether the real time AF list database 132 has at least one AF at step 405. If the RSSI of the main frequency is equal to or greater than the reference RSSI, the frequency switching module 162 does not attempt switching to the AF but returns to step 402 to measure the RSSI of the main frequency at a predefined cycle and receive the AF list.

If the real time AF list database 132 has at least one AF at step 405, the frequency switching module 162 sets n (AF index in AF list) to 1 at step 406. In contrast, if the real time AF list database 132 has no AF at step 405, the frequency switching unit 162 does not attempt switching to the AF but returns to step 402 to measure the RSSI of the main frequency at a predefined cycle and receives the AF list. If the real time AF list database 132 has no AF, this means that it is not the condition to switch to the AF.

The frequency switching unit 162 measures RSSI of the $n^{th}$ AF at step 407. If n is set to 1, the frequency switching module 162 measures the RSSI of the first AF. The frequency switching module 162 determines whether the RSSI of the $n^{th}$ AF is equal to or greater than a predefined valid RSSI at step 408. If the RSSI of the $n^{th}$ AF is equal to or greater than the valid RSSI, the frequency switching module 162 determines whether the PI code of the $n^{th}$ AF matches with the PI code of the main frequency at step 409. If the PI codes of the $n^{th}$ AF and the main frequency match with each other, the frequency switching module 162 performs switching to the $n^{th}$ AF at step 410.

If the RSSI of the $n^{th}$ AF is less than the valid RSSI at step 408, the frequency switching module 162 updates the AF RSSI list database 133 by adding the RSSI of the $n^{th}$ AF at step 411. In an exemplary embodiment of the present invention, the AF RSSI list may include the RSSIs that are individually less than the valid RSSI among RSSIs measured by the frequency switching module 162 and used as the reference to determining whether to attempt switching to the AF.

The frequency switching module 162 determines whether n has reached N at step 412. That is, the frequency switching module 162 determines whether the RSSI measurement has been performed on all of the AFs in the accumulated AF list at step 412. If it is determined that n has not reached N at step 412, the frequency switching module 162 increments n by 1 at step 413. That is, the frequency switching module 162 selects the AF to measure the RSSI thereof. After incrementing n by 1, the procedure goes to step 407 to measure RSSI of the $n^{th}$ AF (AF having the next index).

In contrast, if it is determined that n has reached N at step 412, the frequency switching module 162 determines whether the proportion of the AFs fulfilling the condition of good RSSI in the accumulated AF list is equal to or greater than a predefined proportion (M) % at step 414. According to an exemplary embodiment of the present invention, the good RSSI as the reference value for determining the current electric field condition may be set to a value less than the reference RSSI and valid RSSI. The frequency switching module 162 determines whether the proportion of the RSSIs equal to or greater than the good RSSI is equal to or greater than M %.

If the proportion of the RSSIs equal to or greater than the good RSSI is less than M %, the frequency switching module 162 determines that the current electric field is poor and deletes the accumulated AF list from the accumulated AF list database 131 at step 415. After deleting the accumulated AF list, the procedure goes to step 402 to receive the AF list at the predefined cycle and configures the accumulated AF list and real time AF list.

If the proportion of the RSSIs equal to or greater than the good RSSI is equal to or greater than M %, the frequency switching module 162 determines that the current electric field condition is good so as to maintain the accumulated AF list and returns to step 402.

If the PI codes of the $n^{th}$ AF and the main frequency differ from each other at step 409, the frequency switching module 162 increments n by 1 at step 416. That is, the frequency switching module 162 selects the next AF to measure the RSSI thereof. Thereafter, the frequency switching module 162 measures the RSSI of the $n^{th}$ AF (AF having the next index) at step 407.

In the second exemplary embodiment of the present invention, the terminal 100 determines whether the proportion of the AFs of which RSSIs are individually equal to or greater than the good RSSI is equal to or greater than a predefined value and, if not, deletes the accumulated AF list to avoid an unnecessary switching attempt to an AF. In addition, since the real time AF list is used along with the accumulated AF list and the frequency switching is attempted when at least one AF exists in the real time list, it is possible to reduce the number of unnecessary switching attempts to the AF.

Figure 5A:
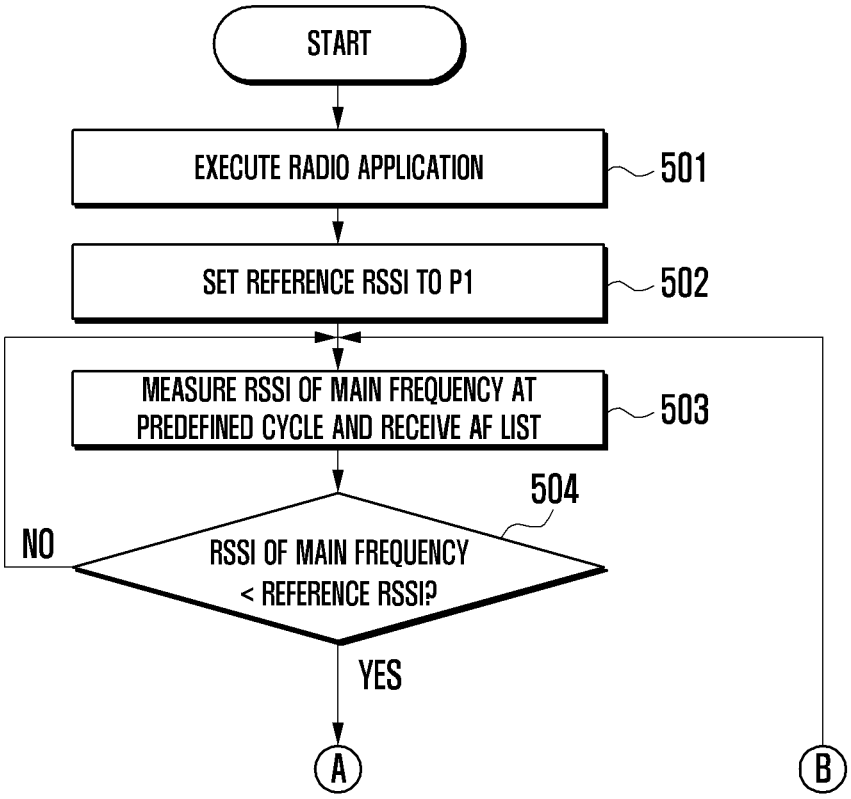
FIGS. 5A and 5B are flowcharts illustrating a frequency switching method of a terminal according to exemplary embodiments of the present invention.
Figure 5B:
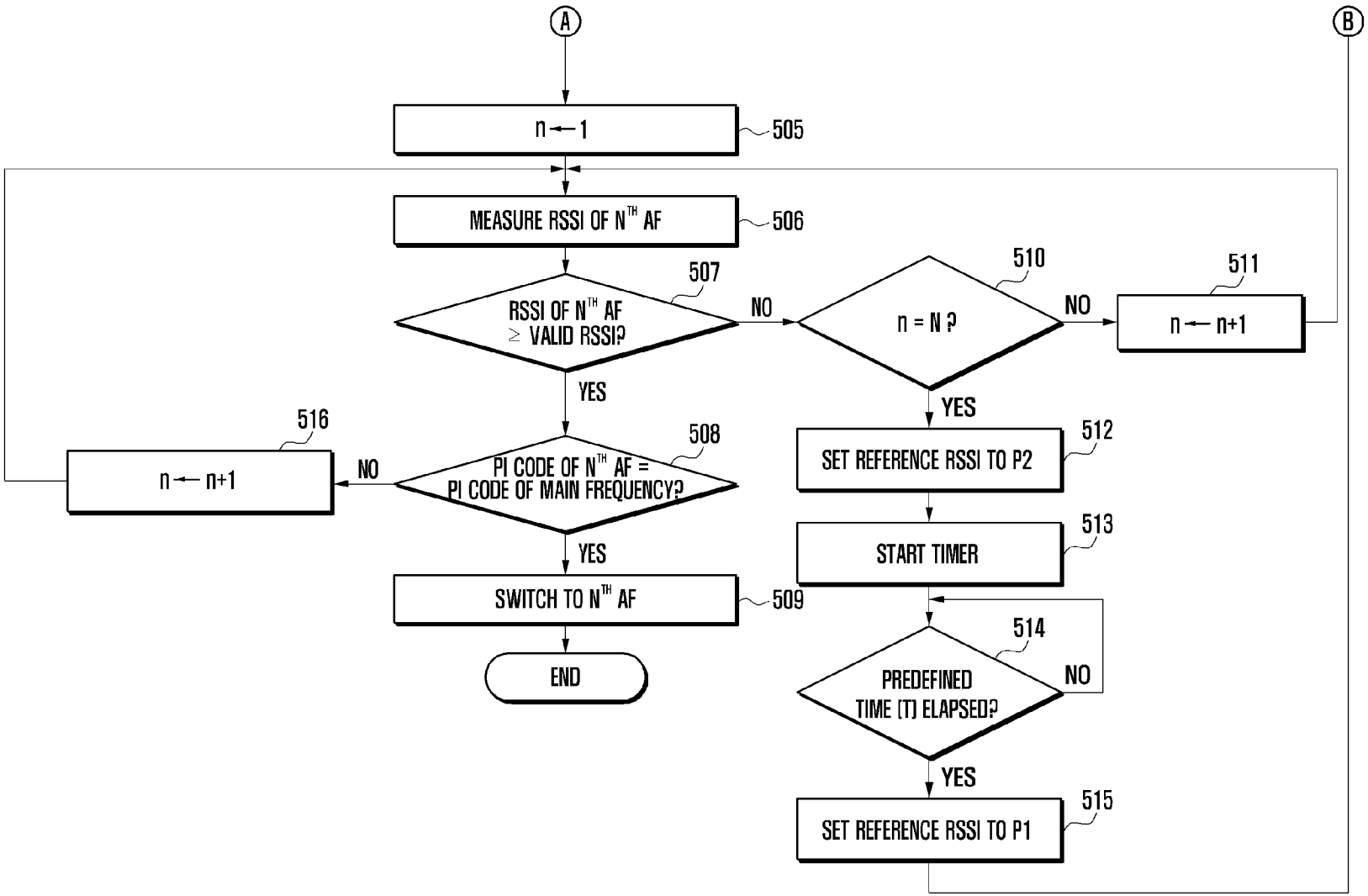

FIGS. 5A and 5B are flowcharts illustrating a frequency switching method of a terminal according to exemplary embodiments of the present invention.

Referring to FIGS. 5A and 5B, the frequency switching method suitable for an environment where the electric field is temporarily weakened by a cause, such as holding the antenna of the terminal 100, is illustrated.

The control unit 160 executes the radio application at step 501, and the reference RSSI configuration module 163 sets the reference RSSI to P1 at step 502. P1 is a default value of the reference RSSI, and the reference RSSI configuration module 163 sets the reference RSSI to P1 when the radio application is executed initially.

The frequency switching module 162 measures the RSSI of the main frequency and receives the AF list by means of the RDS 110 at a predefined cycle at step 503. The frequency switching module 162 compares the RSSI of the main frequency with a predefined reference RSSI to determine whether the RSSI of the main frequency is less than the reference RSSI at step 504.

If the RSSI of the main frequency is less than the reference RSSI, the frequency switching module 162 sets n (AF index in AF list) to 1 at step 505. In contrast, if the RSSI of the main frequency is equal to or greater than the reference RSSI at step 504, the frequency switching module 162 does not attempt switching to an AF but returns to step 503 to measure the RSSI of the main frequency at a predefined cycle and receive the AF list.

The frequency switching module 162 measures the RSSI of the $n^{th}$ AF. If n is set to 1, the frequency switching module 162 measures the RSSI of the first AF at step 506. The frequency switching module 162 determines whether the RSSI of the $n^{th}$ AF is equal to or greater than a predefined valid RSSI at step 507. If the RSSI of the $n^{th}$ AF is equal to or greater than the valid RSSI, the frequency switching module 162 determines whether the PI code of the $n^{th}$ AF matches with the PI code of the main frequency at step 508. If the PI codes of the $n^{th}$ AF and the main frequency match with each other, the frequency switching module 162 performs switching to $n^{th}$ AF at step 509.

If the RSSI of the $n^{th}$ AF is less than the valid RSSI at step 507, the frequency switching module 162 determines whether n has reached N at step 510. That is, the frequency switching module 162 determines whether the RSSI measurement has been performed on all of the AFs in the accumulated AF list at step 510. If n has not reached N at step 510, the frequency switching module 162 increments n by 1 at step 511. That is, the frequency switching module 162 returns to step 506 to select the next AF to measure the RSSI thereof.

In contrast, if n has reached N at step 510, the frequency switching module 162 sends the reference RSSI configuration module 163 a signal including the information on that the RSSI of each of the AFs in the accumulated AF list is less than the valid RSSI, and the reference RSSI configuration module 163 sets the reference RSSI to P2 at step 512. According to an exemplary embodiment of the present invention, P2 may be a value less than P1. For example, P1 can be set to 10 while P2 is set to 2. The reference RSSI configuration module 163 starts a timer at step 513 and determines whether a predefined time (T) has elapsed at step 514. If the predefined time T has elapsed at step 514, the reference RSSI configuration module 163 resets the reference RSSI to P1 at step 515.

When it is required to compare the RSSI of the main frequency with the reference RSSI, the frequency switching module 162 compares the RSSI of the main frequency with P1 or P2.

If the PI code of the $n^{th}$ AF matches with the PI code of the main frequency at step 508, the frequency switching module 162 increments n by 1 at step 516. That is, the frequency switching module 162 selects the next AF to measure the RSSI thereof. The frequency switching module 162 returns to step 506 to measure the RSSI of the $n^{th}$ AF (AF having the next index).

In the third exemplary embodiment of the present invention, the terminal 100 decreases the reference RSSI under a specific condition to avoid unnecessary switching attempts to an AF and increases the reference RSSI back after a predefined time to dynamically perform the switching to AF according to the situation.

Figure 6A:
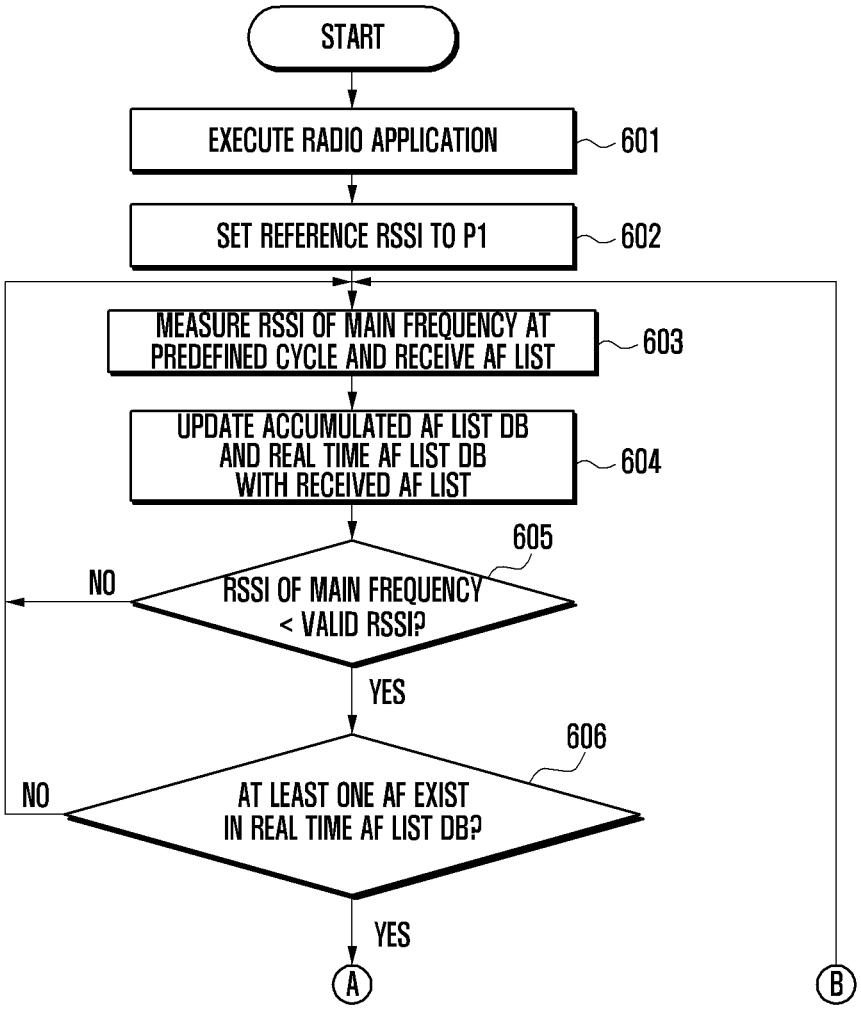
FIGS. 6A and 6B are flowcharts illustrating a frequency switching method of a terminal according to exemplary embodiments of the present invention.
Figure 6B:
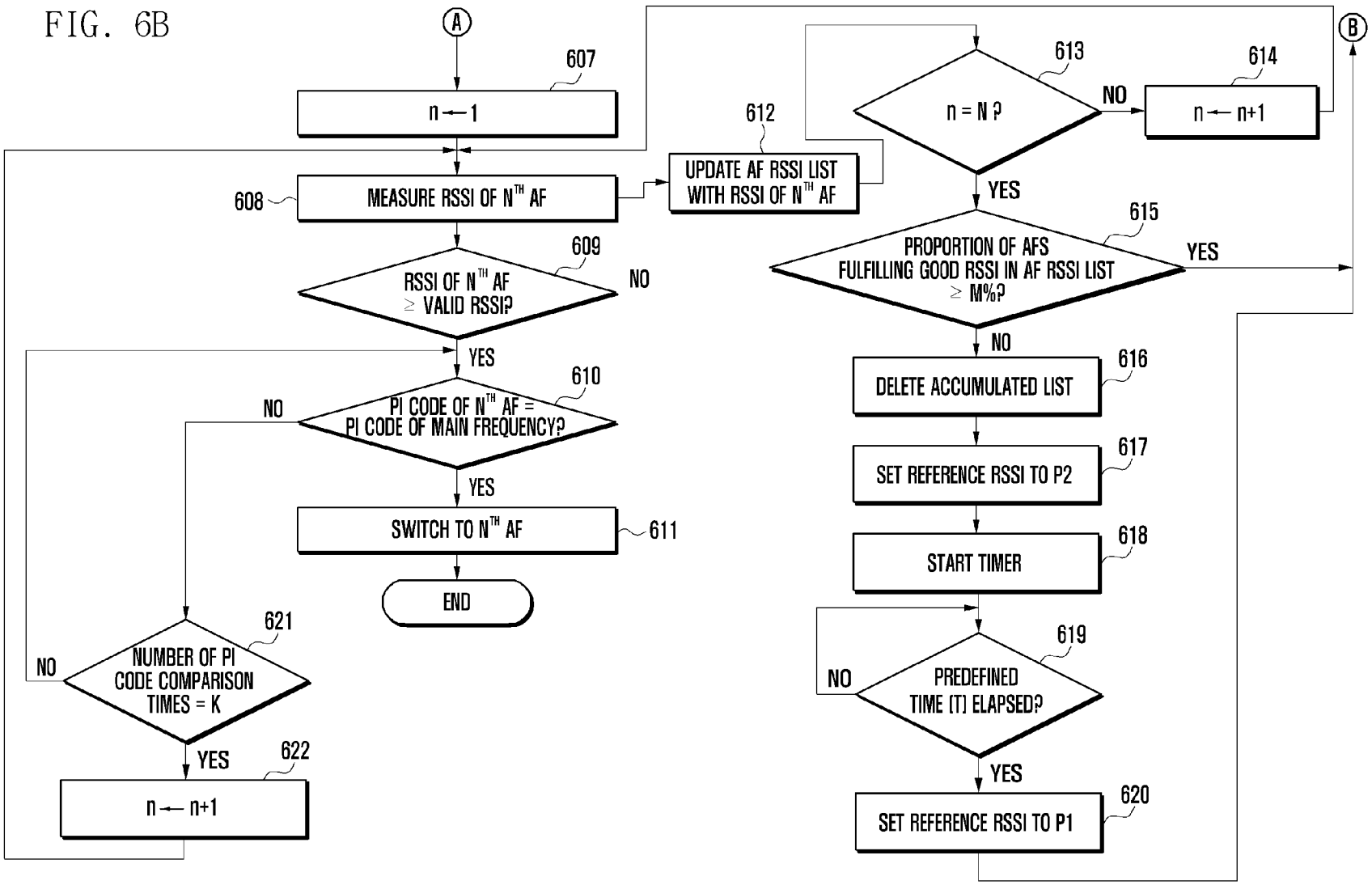

FIGS. 6A and 6B are flowcharts illustrating a frequency switching method of a terminal according to exemplary embodiments of the present invention.

Referring to FIGS. 6A and 6B, the frequency switching method generalizing the first through third exemplary embodiments of the present invention is illustrated.

The control unit 160 executes the radio application at step 601, and the reference RSSI configuration module 163 sets the reference RSSI to P1 at step 602. The frequency switching module 162 measures the RSSI of the main frequency at a predefined cycle and receives the AF list by means of the RDS tuner 110 at step 603.

The frequency switching module 162 updates the accumulated AF list database 131 and the real time AF list database 132 with the AF list at step 604. The frequency switching module 162 updates the real time AF list database 132 by replacing the previously stored AF list with the newly received AF list.

The frequency switching module 162 compares the RSSI of the main frequency with a predefined reference RSSI to determine whether the RSSI of the main frequency is less than the reference RSSI at step 605. If the main frequency RSSI is less than the reference RSSI, the frequency switching module 162 determines whether the real time AF list database 132 has at least one AF at step 606. If the RSSI of the main frequency is equal to or greater than the reference RSSI, the frequency switching module 162 does not attempt switching to the AF but returns to step 603 to measure the RSSI of the main frequency at a predefined cycle and receive the AF list.

If the real time AF list database 132 has at least one AF at step 606, the frequency switching module 162 attempts switching to the AF and sets n (AF index in AF list) to 1 at step 607. This is the process to select the first AF to measure the RSSI thereof. In contrast, if the real time AF list database 132 has no AF at step 606, the frequency switching unit 162 does not attempt switching to the AF but returns to step 603. If there is no AF in the real time AF list database 132, this means that the current situation is not the situation for switching to the AF.

The frequency switching module 162 measures the RSSI of the $n^{th}$ AF at step 608. If n is set to 1, the frequency switching module 162 measures the RSSI of the first AF. The frequency switching module 162 determines whether the RSSI of the $n^{th}$ AF is equal to or greater than a predefined valid RSSI at step 609. If the RSSI of the $n^{th}$ AF is equal to or greater than the valid RSSI, the frequency switching module 162 determines whether the PI code of the $n^{th}$ AF matches with the PI code of the main frequency at step 610. If the two PI codes match with each other, the frequency switching module 162 performs switching to the $n^{th}$ AF at step 611.

If the RSSI of the $n^{th}$ AF is less than the valid RSSI at step 609, the frequency switching module 162 updates the AF RSSI list database 133 with the RSSI of the $n^{th}$ AF at step 612. The frequency switching module 162 determines whether n has reached to N at step 613. That is, the frequency switching module 162 determines whether the RSSI measurement has been performed to all of the AF in the accumulated AF list at step 613. If n has not reached N at step 613, the frequency switching module 162 increments n by 1 at step 614. That is, the frequency switching module 162 selects the next AF to measure the RSSI thereof. The frequency switching module 162 returns to step 608 to measure the RSSI of the $n^{th}$ AF (AF having the next index).

In contrast, if n has reached N at step 613, the frequency switching module 162 determines whether the proportion of the AFs fulfilling the condition of good RSSI in the accumulated AF list is equal to or greater than a predefined proportion (M) % at step 615. If the proportion of the RSSIs equal to or greater than the good RSSI is less than M %, the frequency switching module 162 determines that the current electric field is poor and deletes the accumulated AF list from the accumulated AF list database 131 at step 616. After deleting the accumulated AF list, the frequency switching module 162 sends the reference RSSI configuration module 163 a signal including the information on that the RSSI of each of the AFs in the accumulated AF list is less than the valid RSSI, and the reference RSSI configuration module 163 sets the reference RSSI to P2 at step 617. The reference RSSI configuration module 163 starts a timer at step 618 and determines whether a predefined time (T) has elapsed at step 619. If the time T has elapsed at step 619, the reference RSSI configuration module 163 resets the reference RSSI to P1 at step 620.

If the PI code of the $n^{th}$ AF matches with the PI code of the main frequency at step 610, the frequency switching module 162 determines whether a number of PI code comparison times has reached a predefined value (K) at step 621. If the PI code comparison times has reached K, the frequency switching module 162 increments n by 1 at step 622. That is, the frequency switching module 162 selects the next AF of which RSSI is to be measured. The frequency switching module 162 returns to step 608 to measure the RSSI of the $n^{th}$ AF (AF having the next index).

According to an exemplary embodiment of the present invention, a terminal performs switching to an alternative frequency in consideration of a radio listening environment, thereby reducing unnecessary frequency switching operations and minimizing the sound discontinuation effect caused by frequency switching.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A frequency switching method for a radio data system, the method comprising:

measuring a received signal strength of a main frequency;

receiving at least one alternative frequency list periodically;

creating an accumulated alternative frequency list including all previously received alternative frequency lists;

comparing the received signal strength of the main frequency with a predefined reference received signal strength; and attempting, when the received signal strength of the main frequency is less than the reference received signal strength, switching to an alternative frequency in the accumulated alternative frequency list in sequence, wherein the attempting of the switching of the alternative frequency comprises deleting the accumulated frequency list when the received signal strength of each of the alternative frequencies in the accumulated frequency list is less than a predefined valid received signal strength.

2. The method of claim 1, wherein the attempting of the switching to the alternative frequency comprises:

measuring the received signal strengths of alternative frequencies in the accumulated alternative frequency list in sequence;

determining, when the measured received signal strength is equal to or greater than a predefined valid received signal strength, whether a Program Identification (PI) code determined for the corresponding alternative received signal strength matches with the PI code of the main frequency; and performing, when the PI codes match with each other, switching to the alternative frequency.

3. The method of claim 2, further comprising:

determining, when the measured received signal strength is less than the valid received signal strength, whether the corresponding alternative frequency is the last alternative frequency in the accumulated alternative frequency list;

receiving, when the corresponding alternative frequency is the last alternative frequency, the alternative frequency list at a predefined cycle with deletion of the current accumulated alternative frequency list; and measuring, when the corresponding alternative frequency is not the last alternative frequency, the received signal strength of next alternative frequency.

4. The method of claim 2, further comprising:

determining, when the PI codes differ from each other, whether a number of PI code-matching tests reaches a predefined value;

measuring, when the number of the PI code-matching tests reaches the predetermined value, the received signal strength of next alternative frequency; and repeating, when the number of the PI code-matching tests does not reach the predefined value, the PI code-matching test.

5. The method of claim 1, wherein the creating of the accumulated alternative frequency list comprises generating a real time alternative frequency list with the received alternative frequency list.

6. The method of claim 5, wherein the attempting of the switching to the alternative frequency comprises trying, when the received signal strength of the main frequency is less than the reference received signal strength and the real time alternative frequency list has at least one alternative frequency, to switch to the alternative frequency in the accumulated frequency list.

7. The method of claim 6, wherein the attempting of the switching to the alternative frequency comprises:

measuring the received signal strengths of the alternative frequencies in the accumulated alternative frequency list in sequence;

updating, when the measured received signal strength is less than a predefined valid received signal strength, the alternative received signal strength list with the received signal strength of the corresponding alternative frequency;

determining whether a corresponding alternative frequency is the last alternative frequency in the accumulated alternative frequency list;

calculating, when the corresponding alternative frequency is the last alternative frequency, a proportion of the alternative frequencies of which the received signal strengths are equal to or greater than a predefined good received signal strength in an alternative frequency received signal strength list;

determining whether the proportion is equal to or greater than a predefined value; and receiving, when the proportion is equal to or greater than the predefined value, the alternative frequency list at a predefined cycle with deletion of the accumulated alternative frequency list.

8. The method of claim 7, wherein the predefined good received signal strength can be set to a value less than the reference received signal strength and the valid received signal strength.

9. The method of claim 1, further comprising setting the reference received signal strength to a first value before receiving the alternative frequency list, wherein the attempting of the switching to the alternative frequency comprises:

measuring the received signal strengths of alternative frequencies in the accumulated alternative frequency list in sequence;

determining, when the measured received signal strength is less than a predefined valid received signal strength, whether the corresponding alternative frequency is the last alternative frequency in the accumulated alternative frequency list;

setting, when the corresponding alternative frequency is the last alternative frequency, the reference received signal strength to a second value which is greater than the first value;

starting a timer; and measuring the received signal strength of the main frequency at a predefined cycle.

10. The method of claim 9, further comprising:

determining whether the reference received signal strength is set to the second value;

determining, when the reference received signal strength is set to the second value, whether a predefined time has elapsed after setting the reference received signal is set to the second value;

setting, when the predefined time has elapsed, the reference received signal strength to the first value; and comparing the received signal strength of the frequency with the first value.

11. A Radio Data System (RDS) apparatus comprising:

an RDS tuner for receiving a radio signal containing an alternative frequency list periodically;

an RDS data processing unit for extracting the alternative frequency list from the radio signal;

an accumulated alternative frequency list database for storing an accumulated alternative frequency list including all previously received alternative frequency lists; and a frequency switching module for creating the accumulated alternative frequency list, for measuring a received signal strength of main frequency at a predefined cycle, for comparing the received signal strength of the main frequency with a predefined reference received signal strength, and for attempting, when the received signal strength of the main frequency is less than the reference received signal strength, switching to an alternative frequency in the accumulated alternative frequency list in sequence, wherein the frequency switching module deletes the accumulated frequency list when the received signal strength of each of the alternative frequencies in the accumulated frequency list is less than a predefined valid received signal strength.

12. The RDS apparatus of claim 11, wherein the frequency switching module measures the received signal strengths of the alternative frequencies in the accumulated alternative frequency list in sequence, determines, when the measured received signal strength is less than the valid received signal strength, whether the corresponding alternative frequency is the last alternative frequency in the accumulated alternative frequency list, deletes, when the corresponding alternative frequency is the last alternative frequency, the accumulated alternative frequency list from the accumulated alternative frequency list database, and measures, when the corresponding alternative frequency is not the last alternative frequency, the received signal strength of next alternative frequency.

13. The RDS apparatus of claim 12, wherein the frequency switching module determines, when the measured received signal strength is equal to or greater than a predefined valid received signal strength, whether a Program Identification (PI) code determined for the corresponding alternative frequency matches with the PI code of the main frequency, determines, when the PI codes differ from each other, whether a number of PI code-matching tests reaches a predefined value, measures, when the number of PI code-matching tests reaches the predefined value, the received signal strength of next alternative frequency, and repeats, when the number of PI code-matching tests does not reach the predefined value, the PI code-matching test.

14. The RDS apparatus of claim 11, further comprises a real time alternative frequency list database for storing the real time alternative frequency list including recently received alternative frequency list.

15. The RDS apparatus of claim 14, wherein the frequency switch module attempts, when the received signal strength of the main frequency is less than the reference received signal strength and the real time alternative frequency list has at least one alternative frequency, switching to the alternative frequency in the accumulated frequency list.

16. The RDS apparatus of claim 15, further comprising an alternative frequency received signal strength list database for storing the received signal strengths of the alternative frequencies that are less than a predefined valid received signal strength.

17. The RDS apparatus of claim 16, wherein the frequency switching module measures the received signal strengths of the alternative frequencies in the accumulated alternative frequency list in sequence, stores the received signal strengths of the alternative frequency which is less than the valid received signal strength, determines, when all of the received signal strengths of the alternative frequencies of the accumulated alternative frequency list are less than the valid received signal strength, whether a proportion of the alternative frequencies of which received signal strengths are equal to or greater than a predefined good received signal strength in an alternative frequency received signal strength list, and deletes, when the proportion is equal to or greater than the predefined value, the accumulated alternative frequency list.

18. The RDS apparatus of claim 17, wherein the frequency switching module can set the predefined good received signal strength to a value less than the reference received signal strength and the valid received signal strength.

19. The RDS apparatus of claim 11, further comprising a reference received signal strength configuration module which sets the reference received signal strength to a first value as a default value, resets the reference received signal strength to a second value under the control of the frequency switching module, starts a timer simultaneously with resetting the reference signal strength to the second value, resets the reference received signal strength to the first value when a predefined time has elapsed.

* * * * *